United States Patent [19]

Richter, Sr.

[11] Patent Number: 4,918,413

[45] Date of Patent: Apr. 17, 1990

[54] CLAMP FOR CAPTIVE TUBE IN ELECTROMAGNETIC CIRCUIT BREAKERS

[75] Inventor: Konrad J. Richter, Sr., Lawrenceville, N.J.

[73] Assignee: Heinemann Electric Company, Lawrenceville, N.J.

[21] Appl. No.: 313,954

[22] Filed: Feb. 22, 1989

[51] Int. Cl.[4] ..... H01H 9/02

[52] U.S. Cl. ..... 335/202; 335/59

[58] Field of Search ..... 335/59, 60, 61, 62, 335/202, 239, 240, 241, 242; 200/293, 294, 295, 300, 303

[56] References Cited

U.S. PATENT DOCUMENTS

| | | | |
|---|---|---|---|
| 2,890,306 | 6/1959 | Rypinski et al. | 335/59 |
| 3,729,696 | 4/1973 | Pope | 335/62 |
| 4,062,052 | 12/1977 | Harper et al. | 335/59 |
| 4,237,436 | 12/1980 | Setescak | 335/239 |

*Primary Examiner*—Leo P. Picard
*Assistant Examiner*—Lincoln Donovan
*Attorney, Agent, or Firm*—Dann, Dorfman, Herrell and Skillman

[57] ABSTRACT

An electromagnetic circuit breaker having a frame is supported in fixed position relative to the housing and provides a platform for a bobbin on which is wrapped the electromagnetic coil of the breaker. One flange of the bobbin rests on the frame platform. The other flange supports a flange at the end of a non-magnetic tube containing the movable magnetic core to support the tube and the core in position extending through the center of the coil. The tube is closed by the pole piece which on overload attracts the armature of the breaker. A clamping member is supplied to hold the flange of the tube against the flange of the bobbin and to clamp the entire structure against the frame securely so that it will not move. The clamping means is arranged to contact a wall of the housing having a component generally parallel to the flange. The clamping means is preferably composed of a sheet metal member bent away from the plane of the flange to a point of contact with the housing then bent to conform to the housing. Preferably the other end of the clamping means engages the frame and may be conveniently done by providing a slot in the frame into which a key end of the clamping means is inserted in a position to afford a fulcrum for leverage using the housing wall to impose clamping pressure on the flange.

7 Claims, 1 Drawing Sheet

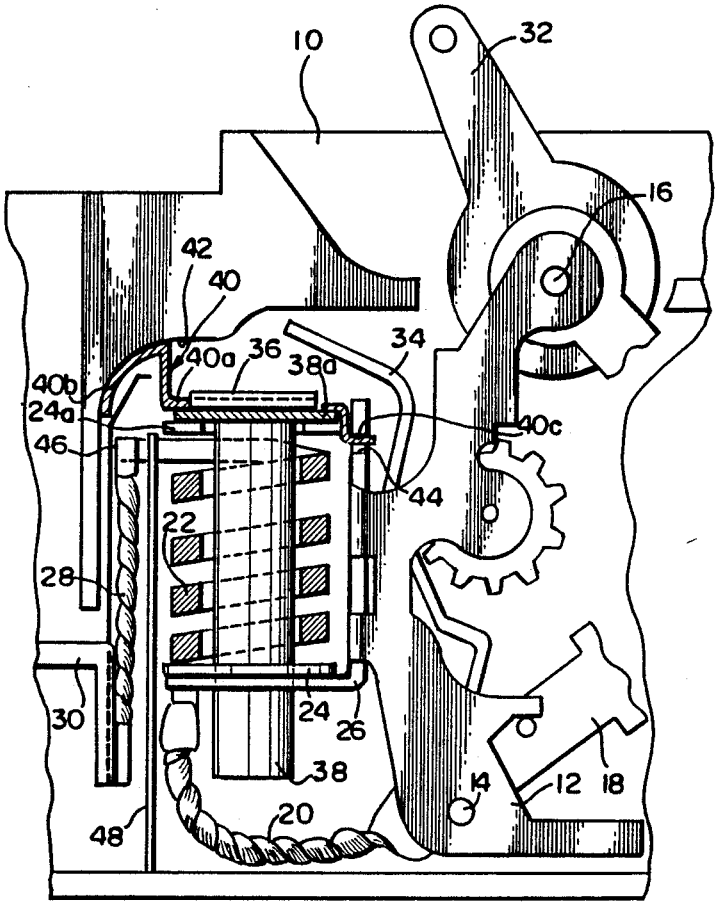
10
32
16
42
40
40a
36
38a
34
40b
24a
46
40c
44
22
28
30
24
26
38
14
12
18
20
48

CLAMP FOR CAPTIVE TUBE IN ELECTROMAGNETIC CIRCUIT BREAKERS

The present invention relates to electromagnetic circuit breakers which employ a movable core, usually immersed in a liquid in a non-magnetic tube placed within the actuating coil of the circuit breaker. More specifically the present invention relates to means for clamping a flange on the tube in position relative to the frame supporting the armature and other elements of the mechanical linkage system which allows actuation of the circuit breaker to open its contacts.

BACKGROUND OF THE INVENTION

For many years it has been common practice to use a movable magnetic core within the actuating electromagnetic coil of a circuit breaker. Commonly the movable core has been a cylindrical structure supported and guided in a non-magnetic tube spring and/or gravity urged away from the pole piece, and rather commonly immersed in a damping fluid to delay the movement of the core toward the pole piece. When the breaker contacts are closed, the current flows through the coil and begins to urge the core toward the pole piece. However, only when the current reaches predetermined overload level is the force strong enough to urge the core to the pole piece and, in turn, attract the movable armature of the breaker toward the pole piece, thereby tripping the breaker and releasing the contacts.

In the past, in order to positively hold the tube supporting the core in position it has been necessary to employ means mechanically connecting the tube to the coil and the frame, thus necessitating fabrication of a sub-assembly which is different for each type of coil and for each combination of other components which comprise the various sub-assemblies. Then it is necessary to maintain a sub-assembly inventory of many types of sub-assemblies ready for use in various types of breakers. Maintaining such an inventory is costly and separately assembling the sub-assemblies and the final breaker assembly is inefficient. At the present time, any changes to parts requires costly off the line salvage disassembly with losses of valuable parts.

THE NATURE OF THE PRESENT INVENTION

The present invention provides a means for clamping the tube holding the magnetic core in place in the course of final assembly of the breaker so that manufacture and inventory of sub-assemblies is not necessary. The construction provides an improved circuit breaker time delay tube retaining means that allows for assembly line manufacturing flexibility and eliminates the need for permanent manufacture of a special subassembly holding the tube in place by welding, soldering or like techniques which normally would require separate preassembly of parts or the manufacture of a special subassembly. In addition the new clamping technique allows for replacement rather than discarding of parts that deviate from the specification during testing and/or expensive salvage of other parts. The present technique also provides a mechanically secure means of clamping a time delay tube to the circuit breaker main frame without the use of a semi-permanent retaining ring or soft solder. Rather than requiring subassembly of parts, the whole assembly is completed on the main assembly line. The present invention allows for immediate production line changes using various tubes and coils and eliminates delay in building of product orders to a variety of specifications for delivery to customers. The advantages of the present invention are accomplished without loss of precise location of the tube pole piece to the tripping mechanism and positive clamping of the parts in position.

In accordance with the present invention the magnetic core containing tube is provided with a radial flange which allows it to be supported atop the coil bobbin which, in turn, is supported at its opposite end on a flange of the frame. Alternatively the flange of the tube may be directly supported on the frame. In either event, the present invention is directed to clamping the flange of the tube against a supporting surface using a clamping member which engages at least the tube flange and a portion of the breaker housing designed for that purpose and so arranged that it will cause the clamp to clamp directly down on the flange of the tube and hold it positively relative to the frame directly or through the coil bobbin.

More specifically the present invention relates to an electromagnetic circuit breaker including an insulating breaker housing containing a series circuit through a pair of breaker switch contacts and a magnetic coil. Also within the housing an actuation linkage for opening and closing the switch contacts is supported on a frame fixed to the housing. The linkage includes magnetic actuating means and a movable armature attractable to a pole piece. The pole piece terminates a non-magnetic tube containing and guiding a magnetic core located within the magnetic coil and having a radially extending tube flange at the pole piece end. The coil and the flange are both supported by the frame. The flange is commonly supported on a bobbin which supports the coil. A clamping member so engages a wall portion on the interior of the housing that a surface of the clamping member will engage the tube flange and urge the tube against its support which acts against the reaction of the frame to hold the tube flange against its supporting surface and clamp all structure between the clamping member and the frame in place.

THE DRAWING OF THE INVENTION

FIG. 1 is a partial showing of a breaker structure with half of the housing removed, the coil and the clamp being shown in cross section, and other parts of the operating structure irrelevant to mechanical support being omitted.

A SPECIFIC EMBODIMENT OF THE INVENTION

Referring now to FIG. 1, the structure shown is part of a circuit breaker structure having a housing 10 employing opposed similar half shells which, when secured together, enclose the circuit and the mechanism of the circuit breaker. One or both of the half shells support terminals (not shown) which extend through the housing to permit connection of the breaker into an electrical circuit. One of the terminals is connected to a fixed contact of the breaker switch (not shown) and the other contact is supported on an arm 18 pivoted to frame 12 made of a folded sheet metal which, in turn, is supported on the housing half shells by various pivot pins which are journaled in each of the respective half shell sidewalls. Two such pins 14 and 16 rotatably support movable contact support and the handle. Part of the contact support structure 18 is shown in open contact position. Electrical connection is made to this lever arm in the vicinity of the movable switch contact or directly to the switch contact by a flexible conductor 20, or pigtail made from stranded wire. The other end of pigtail 20 is connected to one end of coil 22, here shown schematically, and in practice supported on the bobbin or spool 24 which, in turn, rests on a flange 26 of the frame 12. The other end of the coil 22 is connected by a similar flexible stranded wire pigtail 28 to a conductor 30 leading to the other terminal (not shown). Also omitted from the drawing is most of the linkage mechanism which moves movable contact supporting arm 18 into and away from the fixed contact. The linkage mechanism includes a handle 32 by which the breaker contacts may be opened or closed manually. The handle 32 is pivotally supported on the pin 16 and protrudes through the breaker housing 10 so as to be accessible from the outside of the housing. Also involved with the linkage is a pivoted armature 34 which cooperates with a pole piece 36 such that when there is an overload current in the coil 22, the armature 34 will be drawn to the pole piece 36 and its movement will trip the mechanism linkage to open the switch contacts. Many such mechanisms are known and in this case the pivotally supported armature is rotatably supported on the frame 12 to permit linkage actuation in a predetermined manner.

As previously observed in this particular embodiment the spool or bobbin 24 supporting coil 22 is, in turn, supported on frame platform 26. Platform 26 is provided with an opening corresponding to an opening in the bobbin 24 which permits the passage of a non-magnetic tube 38. Tube 38, for example, may be made of brass and in this particular embodiment is provided with a flange **38*a* extending radially from the open end of the tube. Within the tube is located a cylindrical magnetic core (not shown) which may be spring loaded and gravity loaded downward and away from the pole piece 36. Additionally, the tube 38 may contain a damping liquid or fluid, the viscosity of which determines the rate at which the core moves toward the pole piece in the event of overload and hence determines the time lag in the tripping of the breaker. The pole piece 36 is fixed to the open end of the tube against the flange to seal the fluid and the core within the tube. In this particular case the flange 38*a* rests atop a flange 24*a* of the coil bobbin and is thus supported on the frame 12 through the bobbin 24 supported on the frame extension 26**.

In accordance with the invention, in order to avoid the necessity of permanently affixing the coil bobbin to the tube 38 and possibly the whole structure to the frame by soldering or by some mechanical attachment structure, the present invention provides a mechanical means for clamping the structure together. In the prior art, when the tube and coil bobbin were permanently affixed to the frame, it meant that a separate assembly line had to be set up to make various assemblies using different parts, including different bobbins and different coils for different kinds of breakers and different tubes with different kinds of damping fluids would all have to be preassembled in sub-assemblies and held in inventory. However, with the present invention a mechanical clamping arrangement avoids the necessity of doing a separate assembly and pieces for a particular breaker can be assembled on the spot on the same assembly line putting the whole breaker structure together.

More specifically the present invention uses a clamp member generally designated 40 which at a minimum has region **40*a* which conforms to the tube flange 38*a* and preferably has an opening which fits around the pole piece 36 enabling it to make good contact with the flange 38*a*. Additionally the clamping member 40 has a portion 40*b* which bears against a shoulder or surface 42 built into the half shells of the breaker housing. In some instances it may be sufficient to contact the shoulder or surface but preferably it has an area which conforms to a surface on the shoulder 42 and applies pressure to the portion 40*a* to hold the flange 38*a* against the flange 24*a* of the bobbin 24. In the preferred embodiment shown the clamping member 42 also has a portion 40*c* which engages a slot 44 in the frame. This portion as shown in the drawing may be offset from the plane of the clamping portion 40*a* so that the frame need not extend up as high as the pole piece 36 and interfere with the action of the armature 34. In this arrangement the clamping means is referenced directly to the frame, in addition to indirectly pressing the flange 38*a* of the tube 38 into the frame extension 26 through flange 24*a* and the coil bobbin 24**. Clearly other locations for the attachment to the frame could be chosen. Additionally great variation in the coaction between the clamping means and the housing half shell is possible.

Finally in the construction shown it is desirable to provide a flexible insulator 46 between the pigtail 28 and a portion of the tube retainer **40*b* as well as providing an insulator 48 between the coil 22 and the pigtail 28**. The location and support of these insulators, of course, is subject to variation.

It will be appreciated by those skilled in the art that the specific form of the clamping means will differ in different applications. It is also possible that in some cases a portion of the frame may be interposed for direct support of the tube flange **38*a***. Other variations will occur to those skilled in the art. All such variations within the scope of the appended claims are intended to be within the scope and spirit of the present invention.

I claim:

1. An electromagnetic circuit breaker comprising an insulating breaker housing, containing a series circuit within the housing through a pair of breaker switch contacts and a magnetic coil and an actuation linkage supported on a frame fixed to the housing for opening and closing the switch contacts, including a manual actuation means and a movable armature attractable to a pole piece terminating a non-magnetic tube containing and guiding a magnetic core located within the magnetic coil and having a radially extending tube flange at the pole piece end, a bobbin on which the coil is wound and the tube being both supported by the frame, and a clamping member so engaging an interior wall of the housing that a surface of the clamping member will engage the tube flange and urge the tube flange against the reaction of the frame to hold the tube flange against its supporting surface and clamp in place all structure between the clamping member and the frame.

2. An electromagnetic circuit breaker comprising an insulating breaker housing, containing a series circuit within the housing through a pair of breaker switch contacts and a magnetic coil and an actuation linkage supported on a frame fixed to the housing for opening and closing the switch contacts, including a manual actuation means and a movable armature attractable to a pole piece terminating a non-magnetic tube containing and guiding a magnetic core located within the magnetic coil and having a radially extending tube flange at the pole piece end, and a bobbin on which the magnetic coil is wound having a flange at one end supported by the frame and a flange at the other end supporting the tube flange, and a clamping member so engaging an interior wall of the housing that a surface of the clamping member will engage the tube flange and urge the tube flange against the bobbin and the bobbin against the frame to clamp in place the flange and the bobbin between the clamping member and the frame.

3. The electromagnetic circuit breaker of claim 2 in which the clamping member is provided with means to positively engage the frame so that leverage from the frame engaging point can be applied against the flange from the housing contact portion.

4. The electromagnetic circuit breaker of claim 3 in which the clamping member is a formed sheet metal piece having a generally planar portion bearing against the tube flange and is bent away from the plane of the flange toward the area of engagement of the housing

5. The electromagnetic circuit breaker of claim 4 in which the sheet metal member is again bent to lie against a portion of a housing wall having a component parallel to the plane of the flange and is shaped to conform to the shape of a supporting shoulder on the housing.

6. The electromagnetic circuit breaker of claim 5 in which the end of the sheet metal clamping member remote from the housing engaging part is bent the opposite direction past the tube flange in order to engage a portion of the frame kept sufficiently low relative to the flange and the coil to avoid interference with the armature.

7. The electromagnetic circuit breaker of claim 6 in which the clamping member is a sheet metal member having an opening in the planar portion engaging the tube flange to fit around the pole piece and is bent on the side remote from the frame away from the flange toward the housing wall to a point at which it engages the housing wall at which point it is bent and formed to conform to the shape of the wall on the housing which it engages, and the portion at the opposite end of the clamping member includes a member which engages a slot in the frame to form a fulcrum.

* * * * *